US005996120A

United States Patent [19]

Balit

[11] Patent Number: 5,996,120

[45] Date of Patent: Dec. 7, 1999

[54] SWIM AND BODY SUIT SUPPORT SYSTEM

[76] Inventor: Robert Balit, 12480 St. Castin, Montreal, Quebec, H3M 2L8, Canada

[21] Appl. No.: 09/063,584

[22] Filed: Apr. 21, 1998

Related U.S. Application Data

[60] Provisional application No. 60/044,587, Apr. 22, 1997.

[51] Int. Cl.[6] ..... A41B 5/00

[52] U.S. Cl. ..... 2/67; 2/69; 2/243.1

[58] Field of Search ..... 2/67, 69, 243.1; 66/170, 171, 175, 176, 177

[56] References Cited

U.S. PATENT DOCUMENTS

| | | | |
|---|---|---|---|
| Re. 33,406 | 10/1990 | Wior . | |
| 3,425,246 | 2/1969 | Knohl | 66/171 |
| 3,537,279 | 11/1970 | Epley | 66/171 |
| 4,010,627 | 3/1977 | Pernick . | |
| 4,043,156 | 8/1977 | Pernick . | |
| 4,390,999 | 7/1983 | Lawson et al. | 2/409 X |
| 4,571,742 | 2/1986 | Wior . | |
| 4,624,115 | 11/1986 | Safrit et al. | 66/176 |
| 4,682,479 | 7/1987 | Pernick | 66/176 |
| 4,916,755 | 4/1990 | Feigenbaum . | |
| 4,956,878 | 9/1990 | Boynton . | |
| 5,070,710 | 12/1991 | Bolin . | |
| 5,081,854 | 1/1992 | Lonati . | |
| 5,119,511 | 6/1992 | Packer . | |
| 5,359,732 | 11/1994 | Waldman . | |
| 5,479,791 | 1/1996 | Osborne | 66/171 |
| 5,590,548 | 1/1997 | Osborne . | |
| 5,592,836 | 1/1997 | Schuster et al. | 66/176 |
| 5,605,060 | 2/1997 | Osborne | 66/171 |

FOREIGN PATENT DOCUMENTS

| | | |
|---|---|---|
| 1 226 134 | 3/1971 | United Kingdom . |
| WO 93/10678 | 10/1993 | WIPO . |

*Primary Examiner*—Gloria Hale
*Attorney, Agent, or Firm*—Leonard Bloom

[57] ABSTRACT

The present invention is directed to a swim suit comprising an outer garment and an inner liner, wherein the inner liner is joined to the outer garment, and the inner liner being seamless. Furthermore, the inner liner of the swim suit comprises areas of different stitch patterns, different yarns, or a combination thereof that support and control desired areas of the torso. The desired areas of the torso requiring support include the breasts, mid-section, buttocks, or a combination thereof. This invention is also directed to a seamless swim suit. Furthermore, there is disclosed a support structure providing beneficial support and control to the torso, yet being comfortable in use and cost effective to manufacture. This invention is also directed to body suits, or portions thereof, for use as undergarments or on their own that comprise control and support features based on the use of suitable stitch patterns and yarn selections.

17 Claims, 14 Drawing Sheets

SWIM AND BODY SUIT SUPPORT SYSTEM

The present invention as disclosed in Provisional Application No. 60/044,587 filed Apr. 22, 1997 relates to a women's swim or body suit. More particularly, this invention relates to a seamless support structure which can be secured within an outer covering or shell of a swimming suit, or used as body suit or as an undergarment.

BACKGROUND OF THE INVENTION

Swimwear is generally made with 2 components: the outer covering or the shell, which is used for styling, and the inside liner, which is used for support to help the woman's body. Furthermore, there is known within the art body suits that provide shaping support which may be worn as an undergarment.

One of the known structures of swimwear is called the shelfbra. This design is quite flimsy and gives little support, or control of body shape for the women's body. Usually it is worn by women with smaller busts and is also used by competitive swimmers requiring optimal hydrodynamic characteristics to their swimwear. In an alternate version, moulded cups for the breasts are added with different fabrics to hold them in place and a liner made of the same fabric is added in order to bring in the stomach. Usually the complete structure is connected to side seams of the outside shell. There is also know another structure of support liner made with an under wire for support of the breast which can be used in conjunction with the liner for the stomach (U.S. Pat. No. 4,571,742; RE 33,406) which are incorporated herein by reference. Such a structure gives better support for women having larger breasts, but unfortunately during the prolong use those under wires have a tendency to puncture the fabric in which they are enclosed. Furthermore, even though there is a degree of support provided with this structure, there is no control of body shape provided.

There is also known a structure of liner which places control fabric in the back which does all the work that is necessary, however such liner make the complete swimwear extremely bulky and uncomfortable.

There is known a swimming suit called the Miracle-suit, which is constructed from one layer of fabric without using any support liner. However, such fabric is very expensive and do not compliment women with oversized breasts since it has a tendency of compressing all parts of the body without any sculptural shaping of all parts of the body.

There is also known a structure called aquabra which provides a foam core frame, that shapes and supports the breast from underneath giving the same shape as a breast. The aquabra comes in different sizes to suit different styles of breasts. For a more feminine look where a cup is not desired, there is structure called the secret aquabra, which consists of a frame made with 2 layers of material sewn together to provide support to the breasts. However, the aquabra and secret aquabra are expensive and add to the cost of the swimsuit, therefore limiting the market accessibility.

Most of known structures of bathing suits made of combination of 15–20% spandex and 75–80% nylon. Typically, 90% of bathing suit shell is made with 15% spandex and 85% nylon. In some cases the % of spandex may be up 32%.

Currently, to the best of Applicants knowledge, there are no seamless swim suits provide for within the art. U.S. Pat. No. 5,605,060 which is incorporated herein by reference discloses a seamless body suit that is prepared from a tubular knit blank. This body suit comprises modified length stitches in order to provide support for, and yet accommodate, the breast and stomach area while provide some degree of compressive support to the mid torso. However, this structure is not designed to provide controlling support to sculpturally shape desired regions of the torso to any substantial degree. Furthermore, there is no disclosure of different stitch types that could be beneficially used in order to sculpt a torso, nor is there any disclosure of different yams that could be used in order to optimize the shape control function of the body suit.

Presently, existing products give shape, but provide minimal support under the breasts unless a frame or under wire is used. The disadvantages of under wire are numerous: it hurts the breasts, adds unnecessary weight, and eventually comes out. These additional structural elements also increase manufacturing costs. Furthermore, other regions of the torso are only minimally sculpted, compressed or modified in some manner to provide an enhanced appearance.

The present invention is directed to swim suit or body suit that provides a comfortable sculpturing support structure that provides a desired control of breasts, mid torso and buttocks without unnecessarily deforming these parts of the body. With the structure of the present invention there is no need for frames, or wire supports, yet a similar degree of support and sculptural control is achieved as with these prior art structures. In several embodiments of the present invention, the use of stitch patterns and yarns selections that provide for a range of support and control functions within a single garment, while still allowing comfort and flexibility of the garment to the user.

The support structure of the present invention may be used as a support liner for a bathing suit in order to provide an aesthetic outside shape, or as a body suit providing shaping support and control, or as a body suit worn as an undergarment. Furthermore, the body-control garment provided for by this invention is cost effective to manufacture and durable in nature.

The body-control garment as described herein may be worn underneath other clothing, not necessarily swimwear, but is not limited to be exclusively worn underneath other clothing. It is lightweight and gives extreme support and control in different areas of the body.

SUMMARY OF THE INVENTION

The present invention relates to a women's swim or body suit. More particularly, this invention relates to a seamless support system which can be secured within an outer covering or shell of a swimming suit, or used as body suit or as an undergarment.

According to the present invention there is provided a swim suit comprising an outer garment and an inner liner, wherein the inner liner is joined to the outer garment, said inner liner being seamless. Furthermore, the present invention embraces the swim suit as defined above wherein the inner liner comprises areas of different stitch patterns, different yarns, or a combination thereof that support and control desired areas of the torso. The desired areas of the torso requiring support include the breasts, mid-section, buttocks, or a combination thereof.

This invention is also directed to a seamless swim suit.

This invention also includes a seamless support structure providing support and control to a desired area of a torso, said seamless support structure charactertized in comprising at least two different stitch patterns that impart said support and control function to said seamless support structure. This invention also includes the seamless support structure wherein the stitchpatterns are selected from the group consisting of maximum support stitch, medium support stitch, intermediate support stitch, soft selection area stitch, bra back area stitch, and band area stitch. This invention also embraces the seamless support structure as defined above, wherein the support structure is a linner for a swim suit, a bra liner, a mid-section liner, a panty liner, a body suit, or a swim suit.

This invention is also directed to a seamless support structure as defined above wherein the:

i) maximum support stitch is used under the bust, mid-section, anchor portions around buttocks, rear portions around legs, and hip portions;

ii) medium support stitch is used in the waist and rear portions and around legs;

iii) soft selection area stitch is used in the bust, buttock and crotch areas;

iv) intermediate support stitch is used between said maximum support stitch and said soft selection area stitch, front areas around legs and around buttocks;

v) bra back area stitch is used in the bra back area; and vi) the band area stitch is used in the waist band and bra band.

The present invention is also directed to a seamless support structure as defined above further charactertized in comprising at least two different yarns types that aid in imparting said support and control function to said seamless support structure. The at least two yarns may be selected from the group consisting of spandex, bare spandex, nylon, nylon single cover and nylon flat shiny.

Swim suits, swim suit liners, body suits and their associated component parts, of the prior art do not comprise the support and control functions of the support structure of the present invention. The support struct of the present invention is designed to provide controlling support to sculpturally shape desired regions of the torso. In so doing currently available machinery was modified in order to permit the handling of the stitch patterns and yarns used as described herein. Furthermore, there is no disclosure of different stitch types that could be beneficially used in order to sculpt a torso, nor is there any disclosure of different yams that could be used in order to optimize the shape control function of the body suit within the prior art. Prior art products give shape, but provide minimal support under the breasts unless other cumbersome features are included within the ware. These additional structural elements increase manufacturing costs.

The present invention is directed to swim suit or body suit that provides a comfortable sculpturing support structure that provides a desired control of breasts, mid torso and buttocks without unnecessarily deforming these parts of the body. With the structure of the present invention there is no need for frames, or wire supports, yet a similar degree of support and sculptural control is achieved as with these prior art structures. In several embodiments of the present invention, the use of stitch patterns and yarns selections that provide for a range of support and control functions within a single garment, while still allowing comfort and flexibility of the garment to the user.

The support structure of the present invention may be used as a support liner for a bathing suit in order to provide an aesthetic outside shape, or as a body suit providing shaping support and control, or as a body suit worn as an undergarment. Furthermore, the body-control garment provided for by invention is cost effective to manufacture and durable in nature.

BRIEF DESCRIPTION OF THE DRAWINGS

These and other features of the invention will become more apparent from the following description in which reference is made to the appended drawings wherein:

FIG. 23(*a*) shows pattern no. "1×1×4 alternate";

FIG. 23(*b*) shows pattern no. "star";

FIG. 23(*c*) shows pattern no. "1×1×2×2 same needle;

FIG. 23(*d*) shows pattern no. "2 up×1 down alternate";

FIG. 23(*e*) shows pattern no. "E12×2"; and

FIG. 23(*f*) shows pattern number "1×1×2A"

DESCRIPTION OF PREFERRED EMBODIMENT

Figure 2:
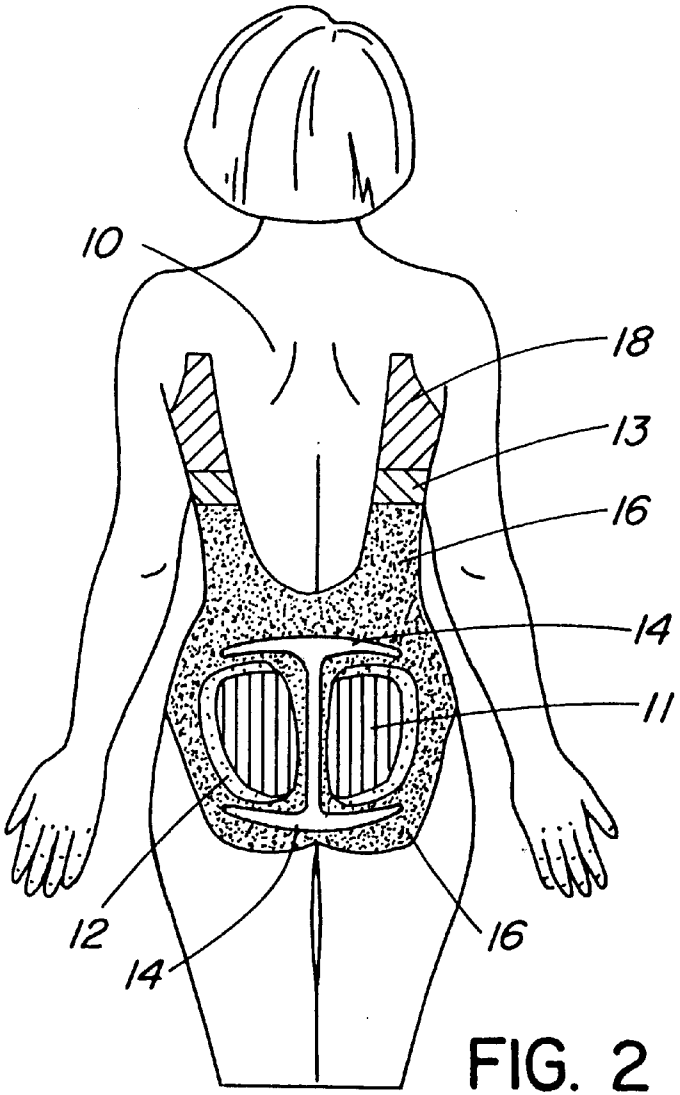
FIG. 2 is a back view of FIG. 1.
Figure 1:
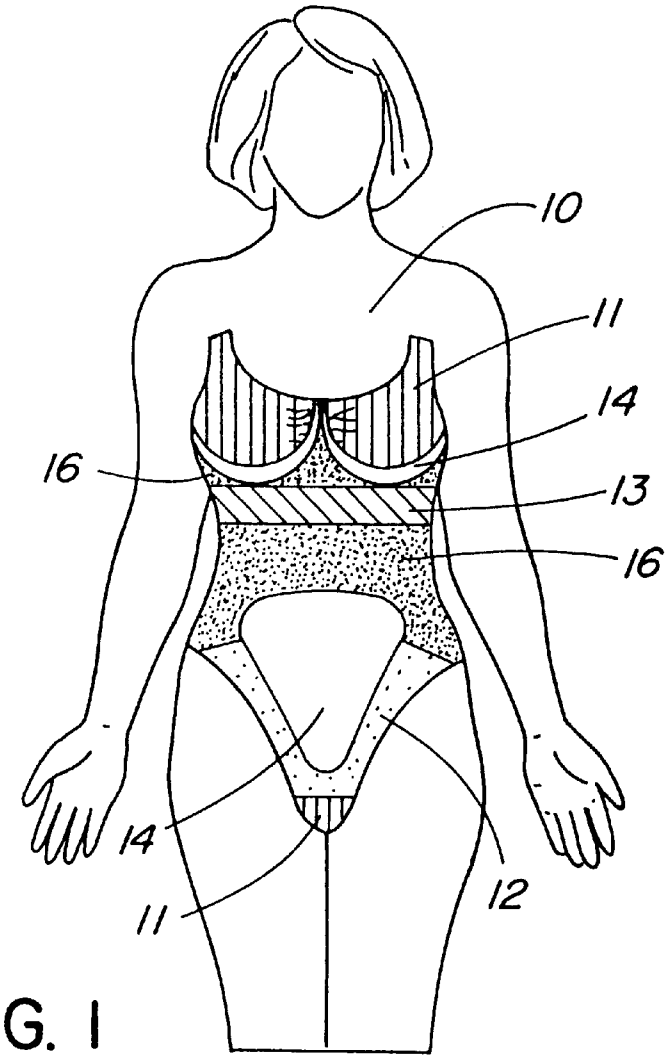
FIG. 1 is a front view of an example of a support structure of the present invention.
Figure 4:
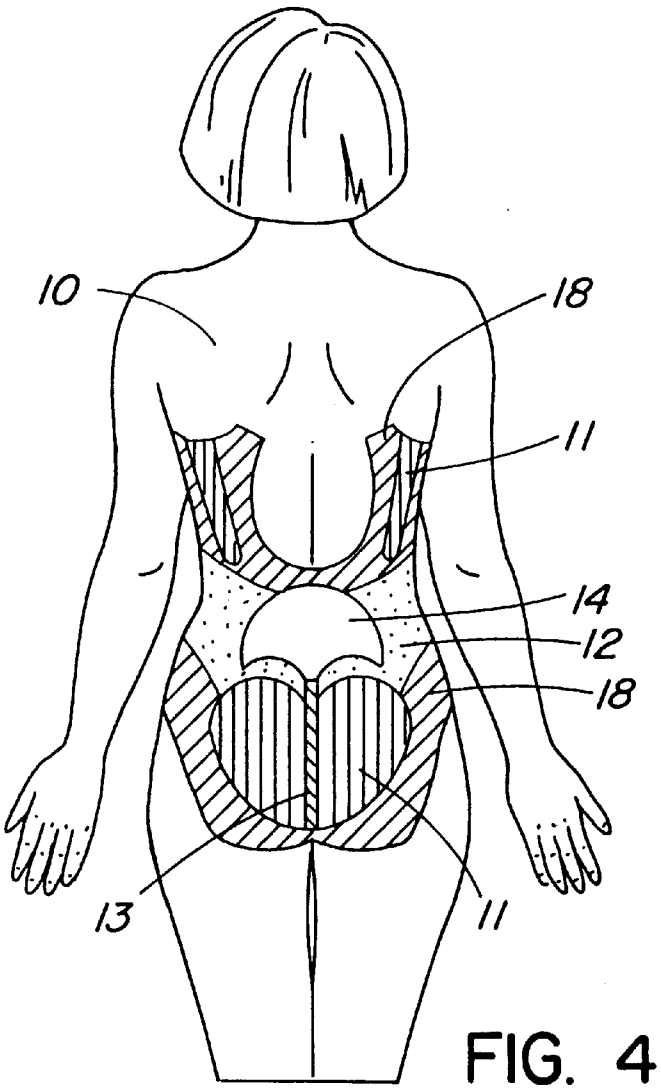
FIG. 4 is a back view of FIG. 3.
Figure 3:
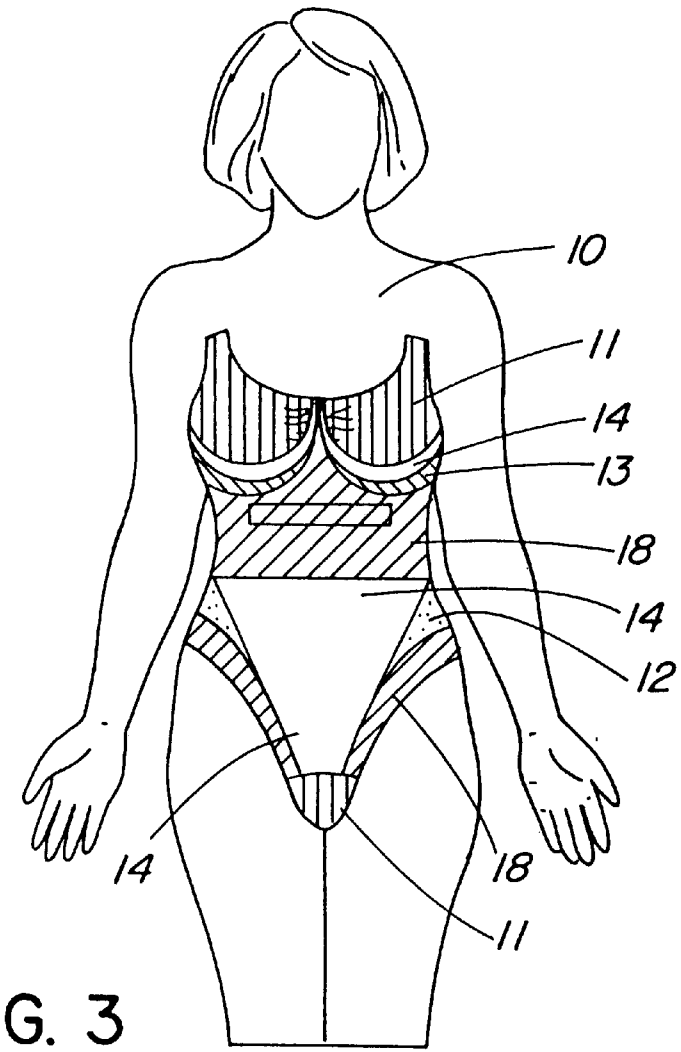
FIG. 3 is a front view of an other example of a support structure of the present invention.
Figure 6:
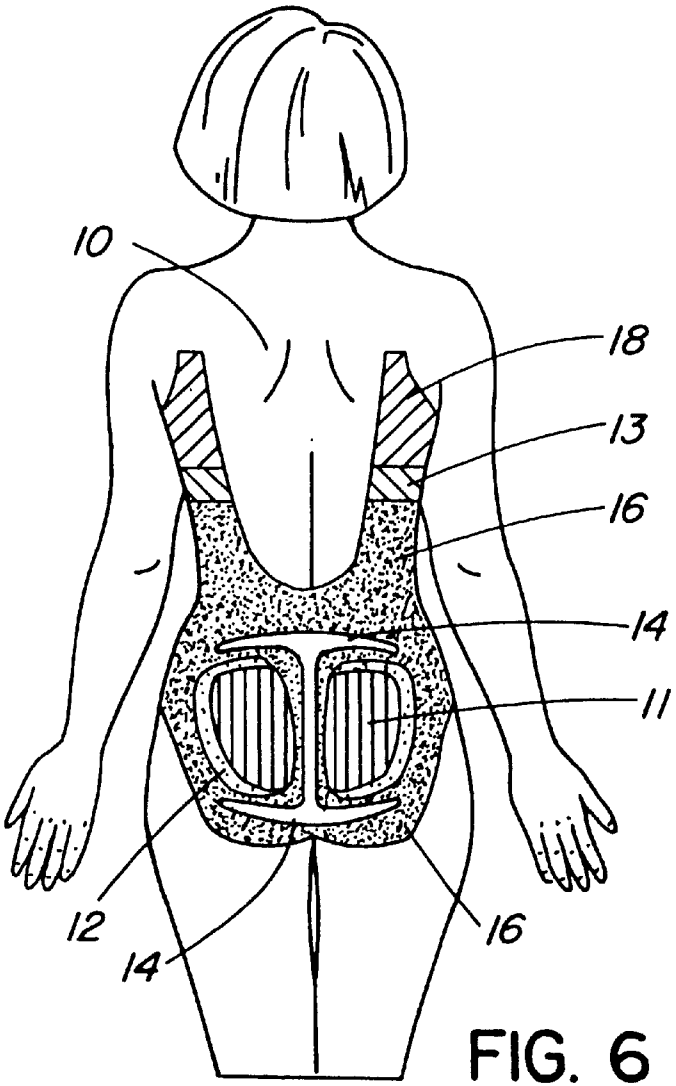
FIG. 6 is a back view of FIG. 5.

The present invention relates to a women's swim or body suit More particularly, this invention relates to a seamless support structure which can be secured to an outer covering or shell of a swimming suit, or used as body suit or as an undergarment.

The present invention incorporates the techniques employed within hosiery manufacturing in view of the fact that hosiery is cheap, light, and seamless. In view of these advantages it was desirable to adapt the techniques of producing hosiery to the process of producing swimwear and body suits of the present invention. This approach allows for the production of a glove-like support structure while permitting control of the stitch pattern and tightness of stitch, as well as interchanging a selection of yarns to advantageously sculpt a woman's body. As a result, the glove-like structure of the support structure is seamless and cheap, yet has durable properties, as well as being capable of stretching and controlling shape and being comfortable to wear.

By "support structure" it is meant a garment that substantially controls the shape of the wearer in a desired for manner in order to, for example, enhance appearance. The support structure provides sculpturing control at least one of the breast, mid-section (stomach), or buttock areas. The support structure of the present invention may be used as a liner underneath a swim suit or other clothing, or may be used as a body suit without any over covering. The support structure of the present invention is considered "whole" if it covers the loin-mid-section-buttock, and breast areas of the torso. However, it is to be understood that the support structure of the present invention may also comprise a garment that provides, in isolation, support to the breast area, or the mid-section, or stomach-buttock areas. These latter garments may also be used as a liner under swimwear, or other outer clothing, or as a piece of clothing in their own right.

The support structure of the present invention may comprise several different embodiments such as a whole liner or body suit shown generally as 10 in the figures. Examples of whole liner or body suit embodiments, which are not to be considered limiting in any manner, are shown in FIGS. 1–8. Furthermore, the swimwear liner and body suit, when used alone or as an undergarment, may also comprise several different embodiments. Examples of these embodiments, which again are not to be considered limiting in any manner, include:

- bra or bra liners and the like, indicated generally as 20 in FIGS. 9–12;
- mid-section-buttock or mid-section-buttock liners indicated generally as 30 in FIGS. 13–16; and
- a lower-section or panty liners indicated generally as 40 in FIGS. 17–20, The garments of FIGS. 9–20 can be used in conjunction or separately.

One of the features of the present invention is that the support structures do not have seams. Another important consideration in designing the liner according to the present invention is to be sure that external forces exerted on the body do not unnecessarily distort the garment. As force is exerted on a controlled part of the body when the support structure is in use, the support structure may also control other parts of the body so that the displaced flesh does not appear elsewhere.

The areas of the body which typically require sculptural control and support are either the bust, the mid-section-stomach, and buttock regions, or any combination thereof. The control and support of the support structure as described herein are provided by different types of stitches, different use of yarns, or a combination thereof. It is therefore necessary to determine the appropriate stitch required in each area, in order that the stitch gives the appropriate control as needed for each area. It is also necessary to take into account how to link the different stitches so that the machine can properly chain them together into one continuous sleeve. Sometimes the stitches cannot not link together, so it is important to determine a suitable combination of stitches.

Figure 21:
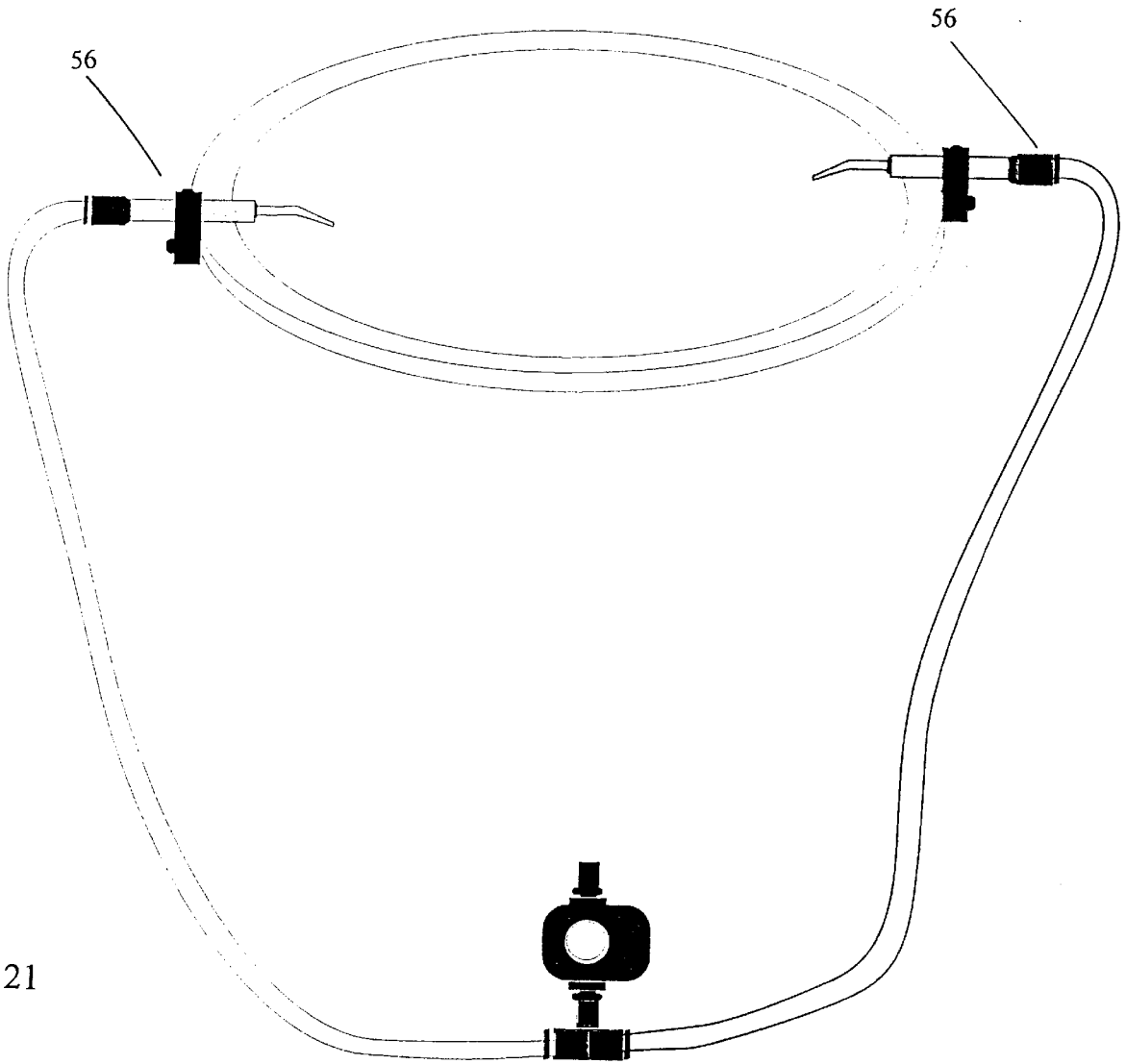
FIG. 21 is a perspective view of a fabric blower sinker caps according the present invention.
Figure 22:
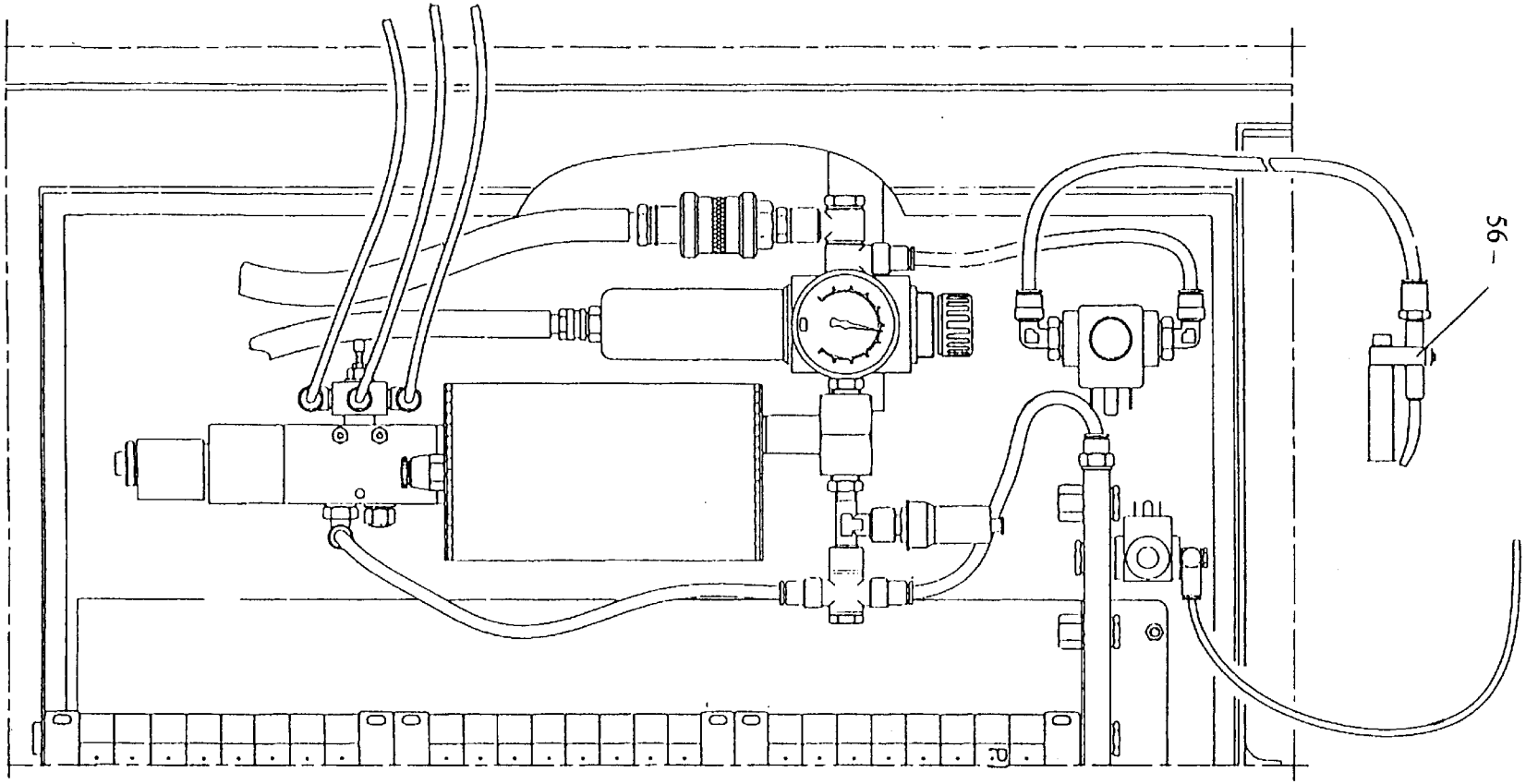
FIG. 22 is a schematic front view of the machine used in the present invention.
Figure 23B:
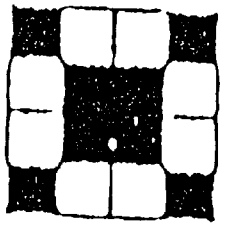
FIG. 23 shows examples of various stitch patterns that may be used in accordance with the present invention.
Figure 23C:
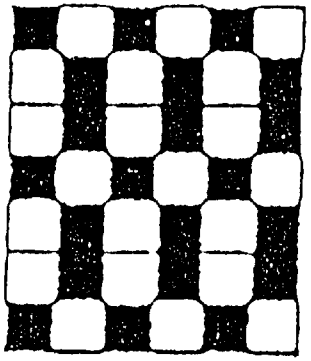
Figure 23A:
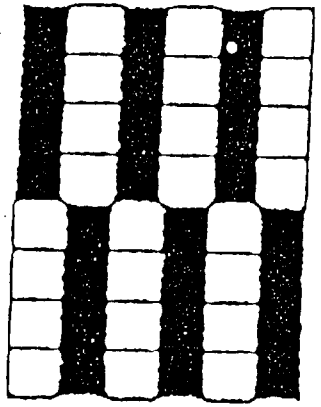
Figure 23E:
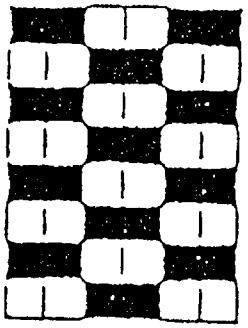
Figure 23F:
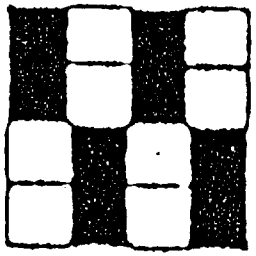
Figure 23D:
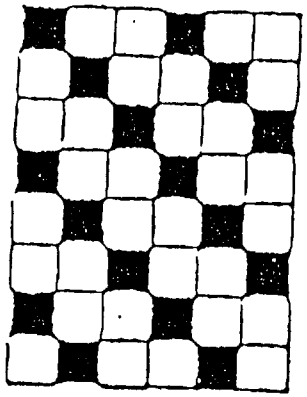

Preferably, but not necessary the machine which is used for making the liner according to the present invention is Santoni SM8/8 shown on FIG. 22. The inventor found that, in order to accommodate several of the stronger that may be used for the manufacture of the support structure as described herein, the machine had to be modified. This is because the use of several yarns lead to frequent jamming of the machine. To facilitate proper operation of this machine for the purpose of the present invention, an additional fabric blower sinker cap 56 was added as shown on FIGS. 21 and 22. This modification was necessary due to certain selections and combinations of yarns that were are employed due to control function of the support structure of the present invention. Such a modification allows the user to push the fabric in order to avoid damaging the machine and breaking the needles.

For designing the support structure according to the present invention it is necessary to:

- determine the power characteristics of each stitch to sculpt the desired area properly;
- translate the shape and power of each stitch into tensions and adjustments on the machine;
- determine the proper characteristics of yarns, such as: size, combination of yarns (spun, spandex, nylon etc.) and quality; and
- determine the stitch shapes (in context of complete garment). In the examples shown in FIGS. 1–8 of present invention, which are not to be considered limiting, 7 different stitches have been employed, wherein each stitch has a different characteristic, determined by its shape and body;
- the garment must be fit, and the number of stitches must be calculated height wise and lengthwise; and
- then, as required, the garment is shaped and fit so that it can be attached to the outside shell of the bathing suit (not shown).

As a result of the present invention a seamless, lightweight, and very strong support structure which provides control in varied areas in order to lift and support the breasts, flatten the mid-section, and lift the buttocks is made available.

The present invention will be further illustrated in the following examples. However it is to be understood that these examples are for illustrative purposes only, and should not be used to limit the scope of the present invention in any manner.

EXAMPLES

Referring to FIGS. 1–8, the support structures are shown as not comprising any shoulder strap, as would be the case if the support structure is to be used as a liner within a swim suit. However, it is also considered within the scope of the present invention that the support structure may also comprise shoulder straps for use as a body suit and the like, including a seamless swim suit.

With regards to FIGS. 1–20 and FIG. 23, the following types of stitches were used in the different areas of the support structure according to the present invention:

Maximum support areas (indicated as 14 in the Figures) used for the following areas of the liner: under the bust, tummy, anchor portions around buttocks, and rear portions around legs (see FIGS. 4, 8, 16, 20), and hip portions (see FIGS. 3, 7, 15, 19):

Suggested pattern of stitch: 1×1×4 alternate (see FIG. 23(*a*))

%Stretch: 170% W×120% L

Type of yarn:

40 spandex×20 nylon single cover (4 feed), 100 nylon flat shiny (4 feed).

Medium support areas (indicated as 16 in the Figures) include the following: waist and rear portions around legs of FIGS. 2, 6, 14 and 18. Several stitch patterns have been found effective in these regions. There are denoted as first and second modifications, below.

Suggested pattern of stitch: First modification: star (see FIG. 23(*b*));

Stretch: 240% W×130% L;

Suggested pattern of stitch: Second modification: 1×1×2A (see FIG. 23(*f*));

%Stretch: 180% W×130% L;

Type of yarn that can be used for both modifications:

40 spandex 20 nylon single cover (4 feed)

100 nylon flat shiny (4 feed)

Intermediate support (indicated as 12 in the Figures) areas are used between maximum support and very soft selection areas (see below), for example in the following areas: front areas around legs and area around buttocks:

Suggested pattern of stitch: 1×1×2×2 same needle (see FIG. 23(*c*))

%Stretch: 220% W×140% L

Type of yarns:

40 spandex 20 nylon single cover (4 feed)

100 nylon flat shiny (4 feed)

Bra back area (indicated as 18 in the Figures):

Suggested type of stitch: 2 up×1 down alternate (see FIG. 23(*d*))

%Stretch: 220 W×160% L

Type of yarn:

40 spandex 20 nylon single cover (4 feed)

Soft selection areas (indicated as 11 in the Figures) include the bust, buttock, and crotch areas:

Suggested type of stitch: neutro O (all needles up)

%Stretch: 240% W×160% L

Type of yarns:

40 spandex 20 nylon single cover (4 feed)

100 nylon flat shiny (4 feed)

Figure 5:
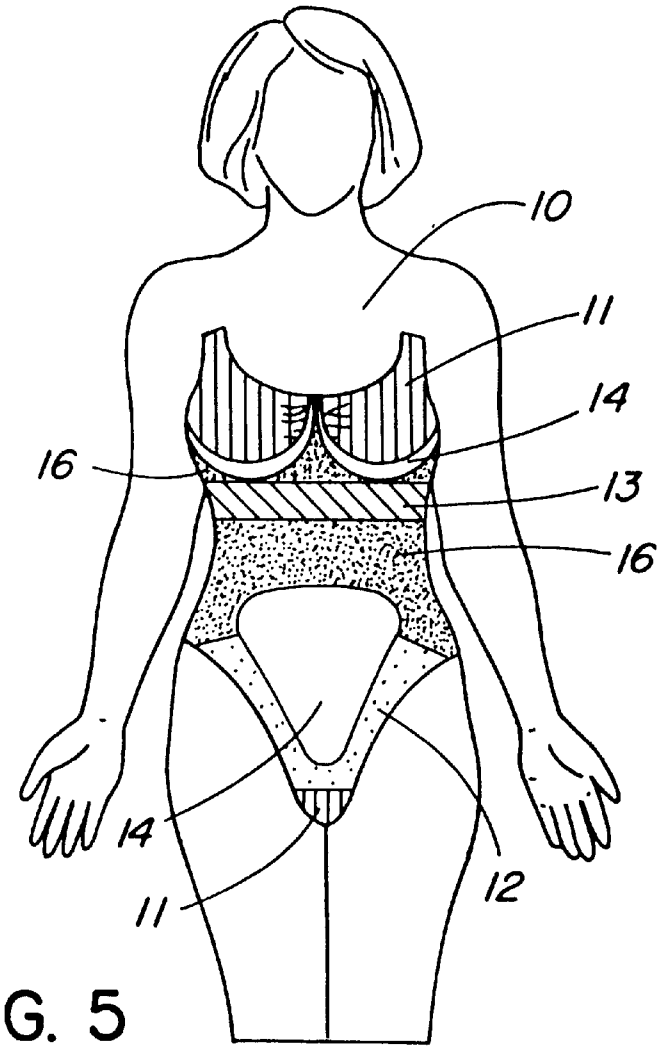
FIG. 5 is a front view of a second embodiment of the liner shown on FIG. 1.
Figure 8:
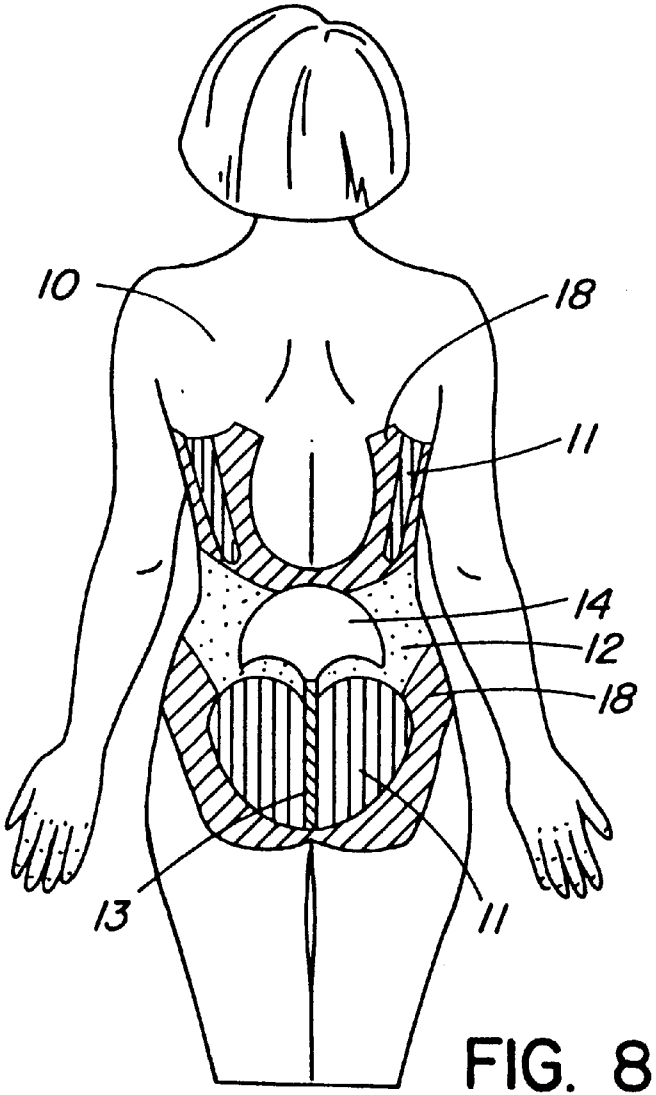
FIG. 8 is a back view of FIG. 7.
Figure 7:
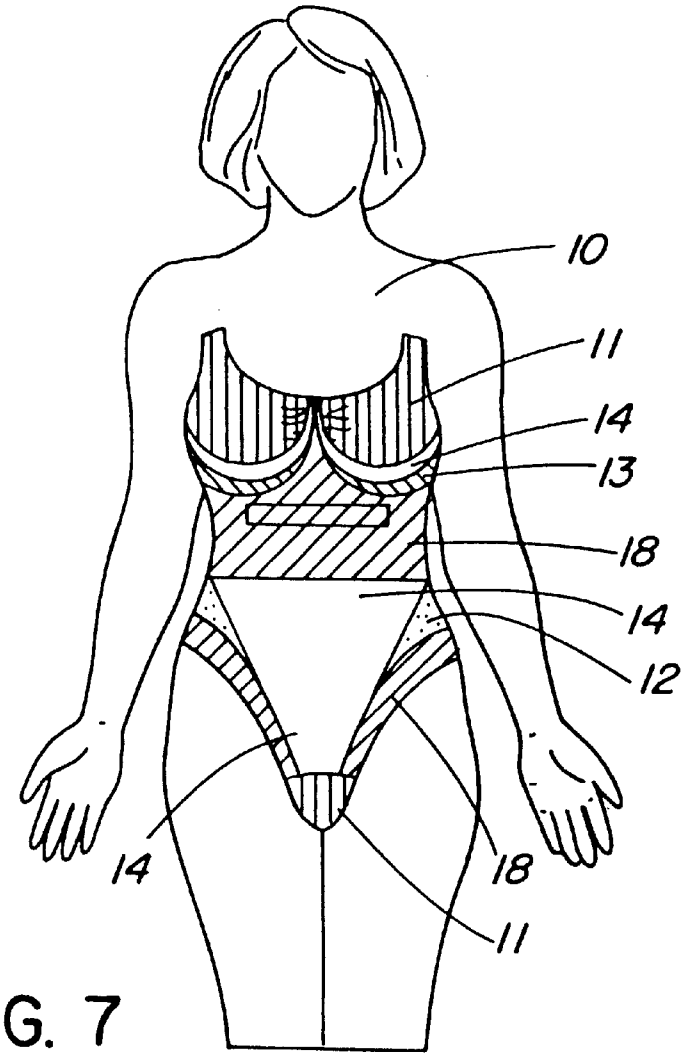
FIG. 7 is front view of a second modification of the liner shown on FIG. 5.
Figure 10:
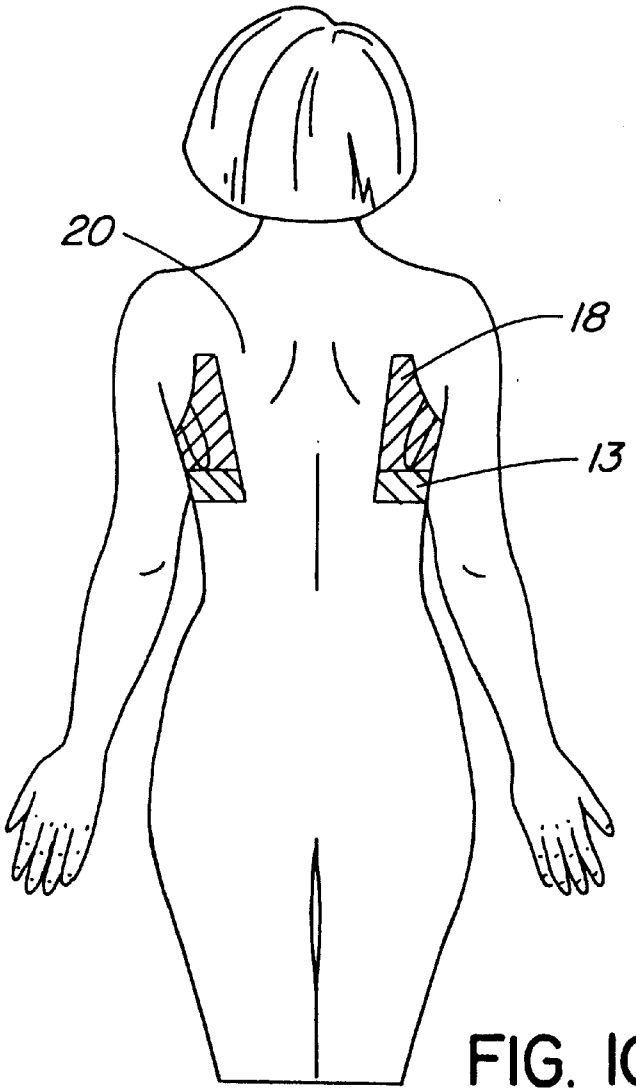
FIG. 10 is a back view of FIG. 9.
Figure 9:
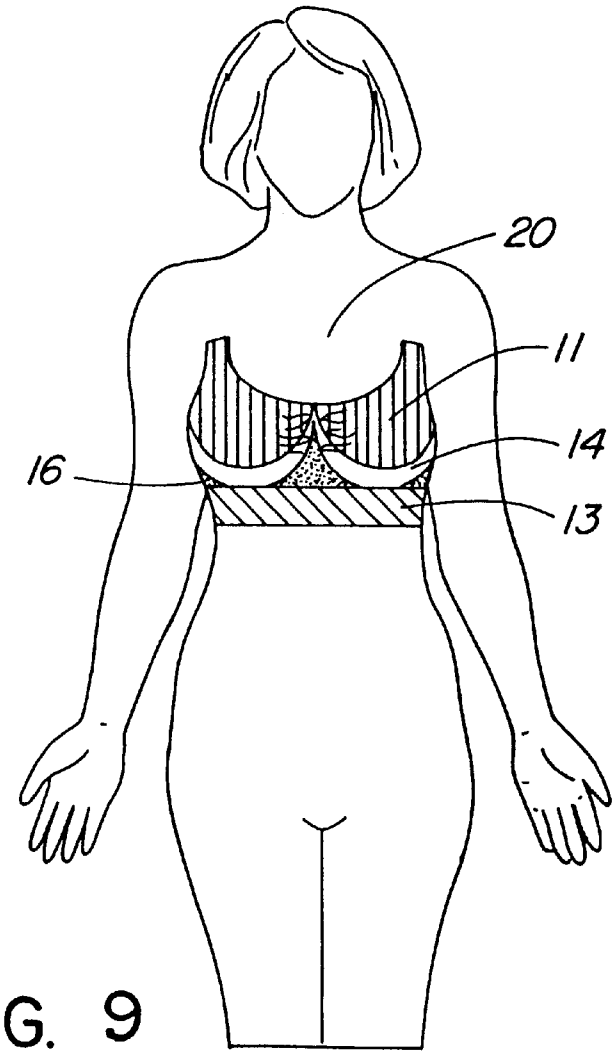
FIG. 9 is a front view of an example of a bra liner according the present invention.
Figure 12:
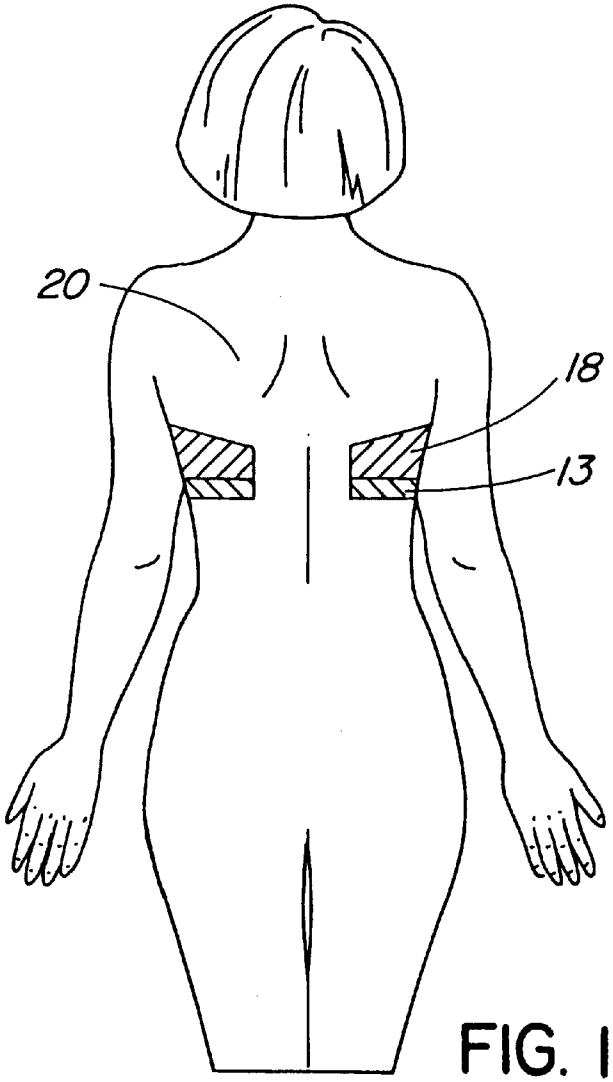
FIG. 12 is a back view of FIG. 11.
Figure 11:
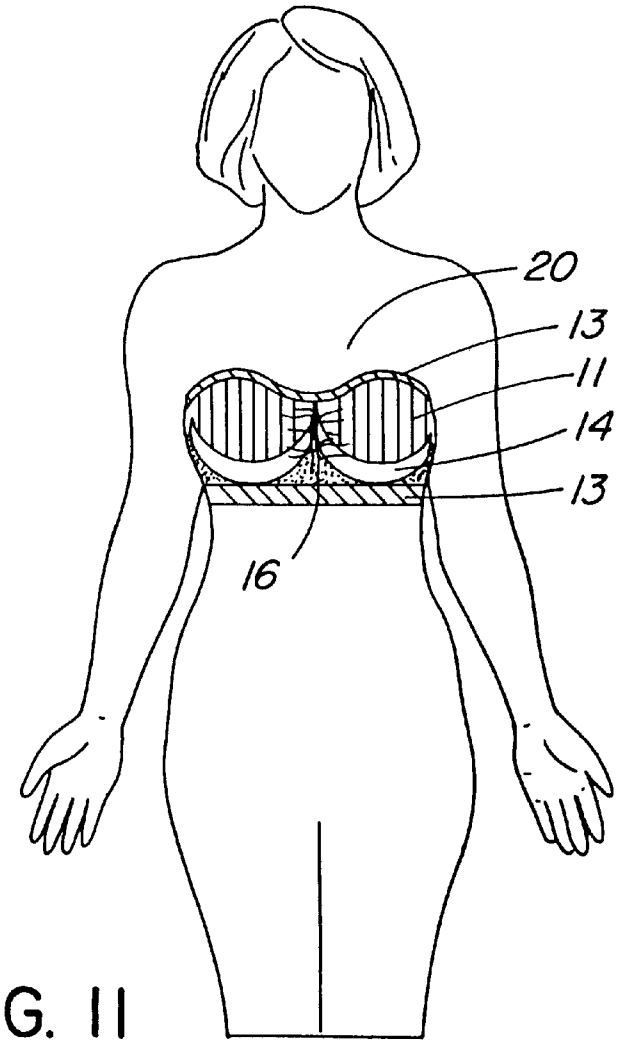
FIG. 11 is a second embodiment of the bra liner of FIG. 9.
Figure 14:
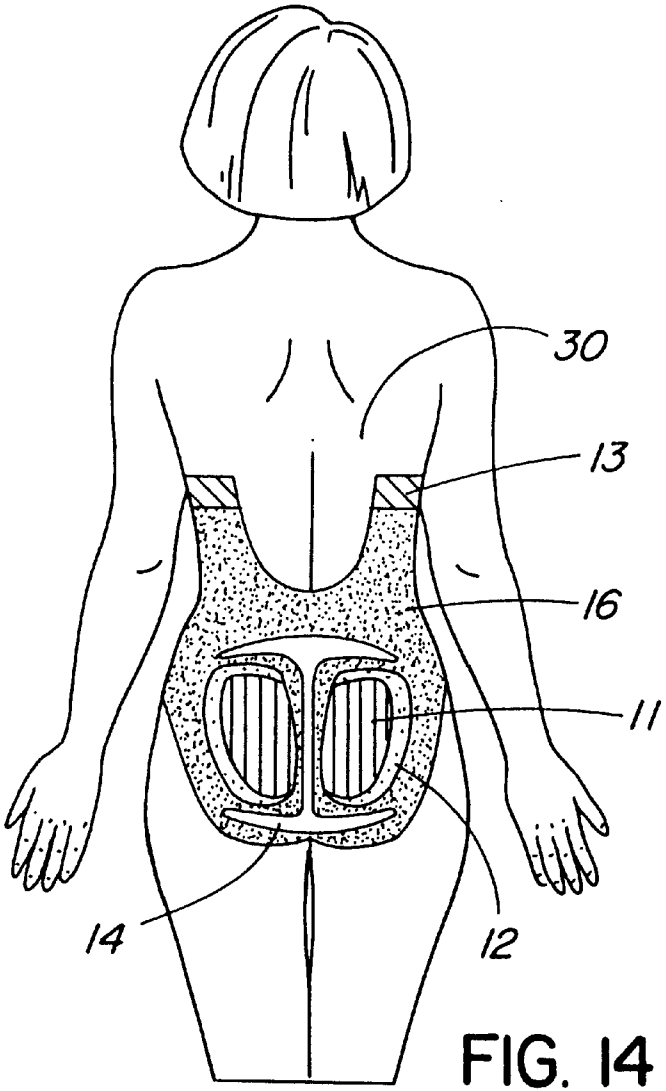
FIG. 14 is back view of FIG. 13.
Figure 13:
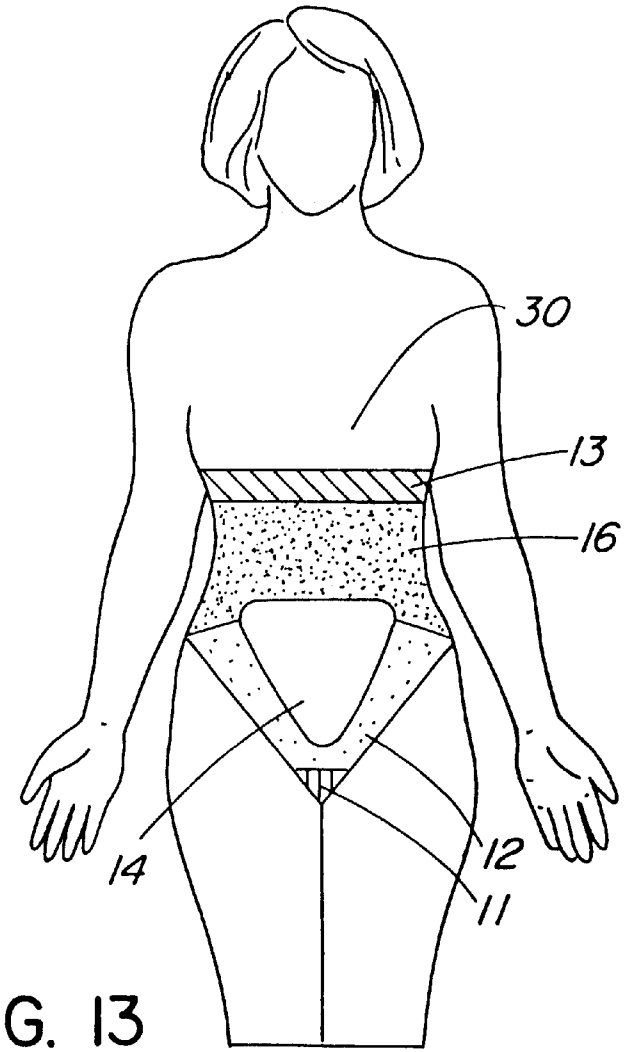
FIG. 13 is a front view of an example of a mid-section-buttock liner according the present invention.
Figure 16:
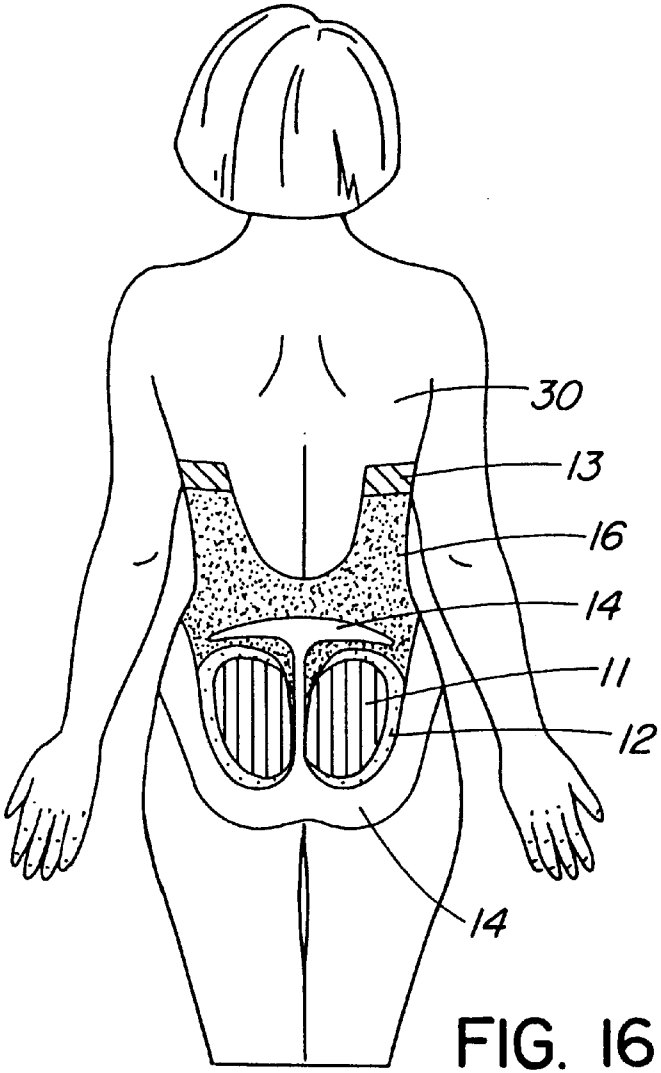
FIG. 16 is a back view of FIG. 15.
Figure 15:
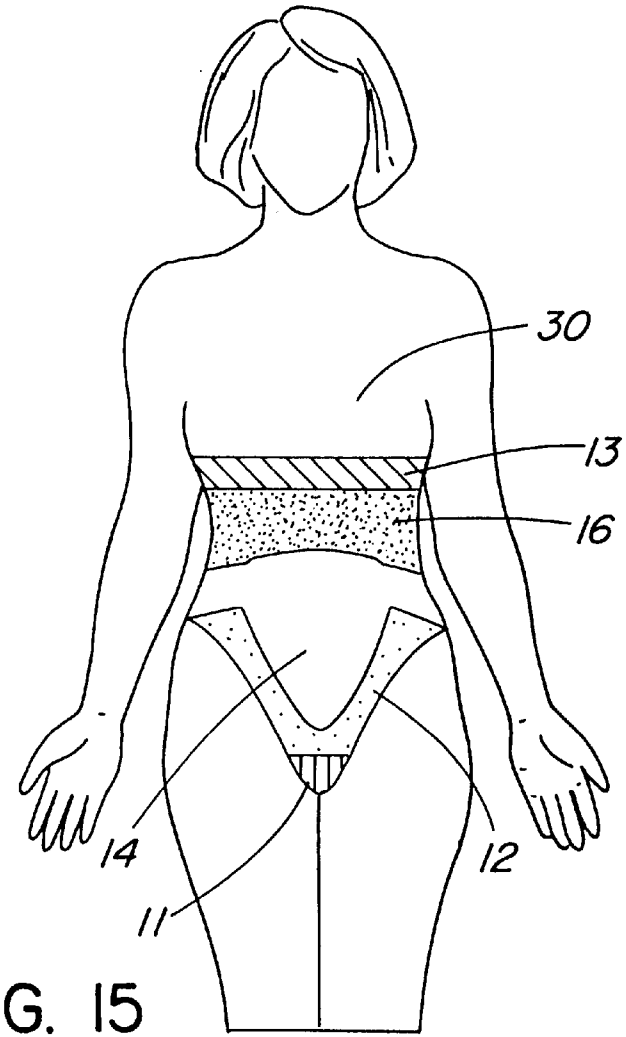
FIG. 15 is a front view of a second embodiment of the mid-section-buttock liner of FIG. 13.
Figure 18:
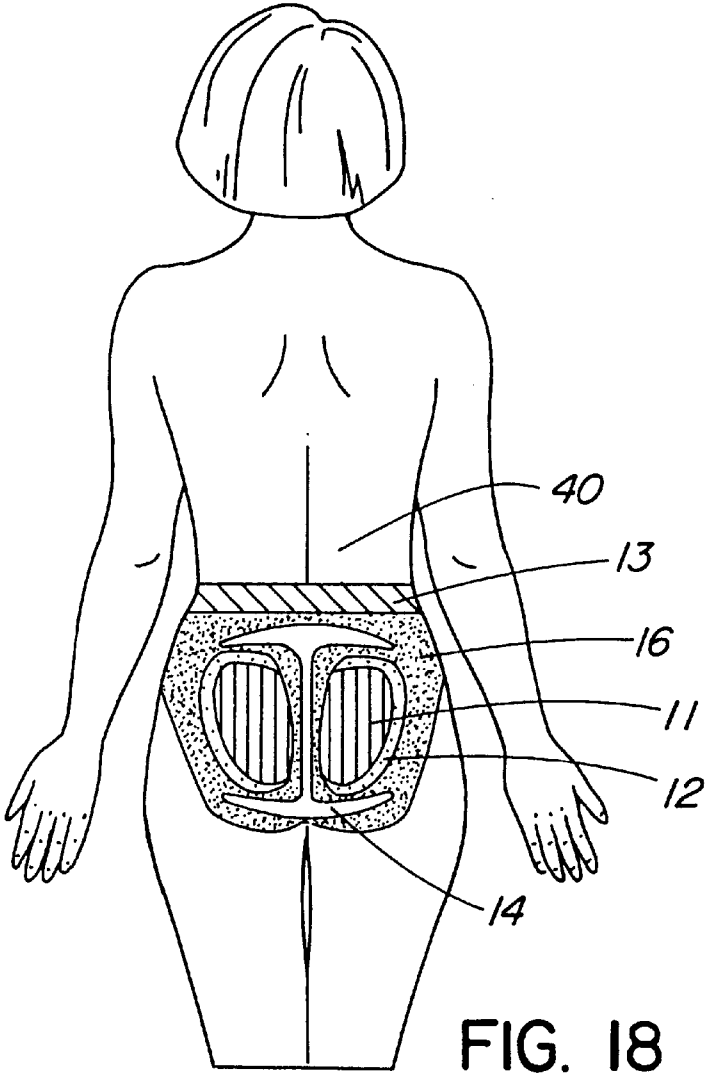
FIG. 18 is a back view of FIG. 17.
Figure 17:
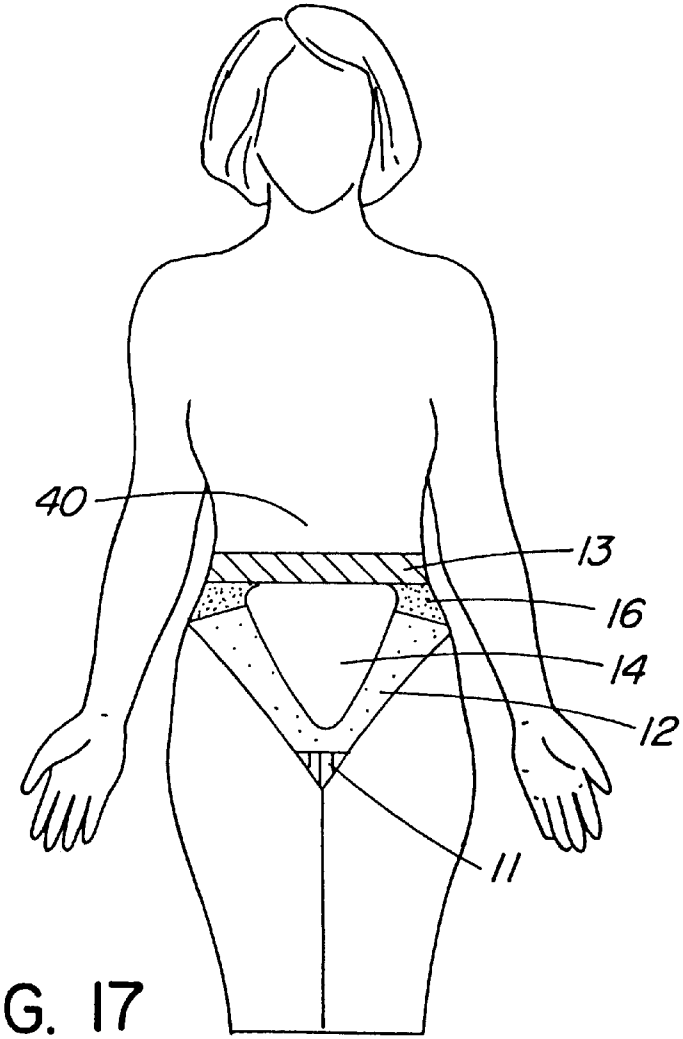
FIG. 17 is a front view of an example of a panty-buttock liner according the present invention.
Figure 20:
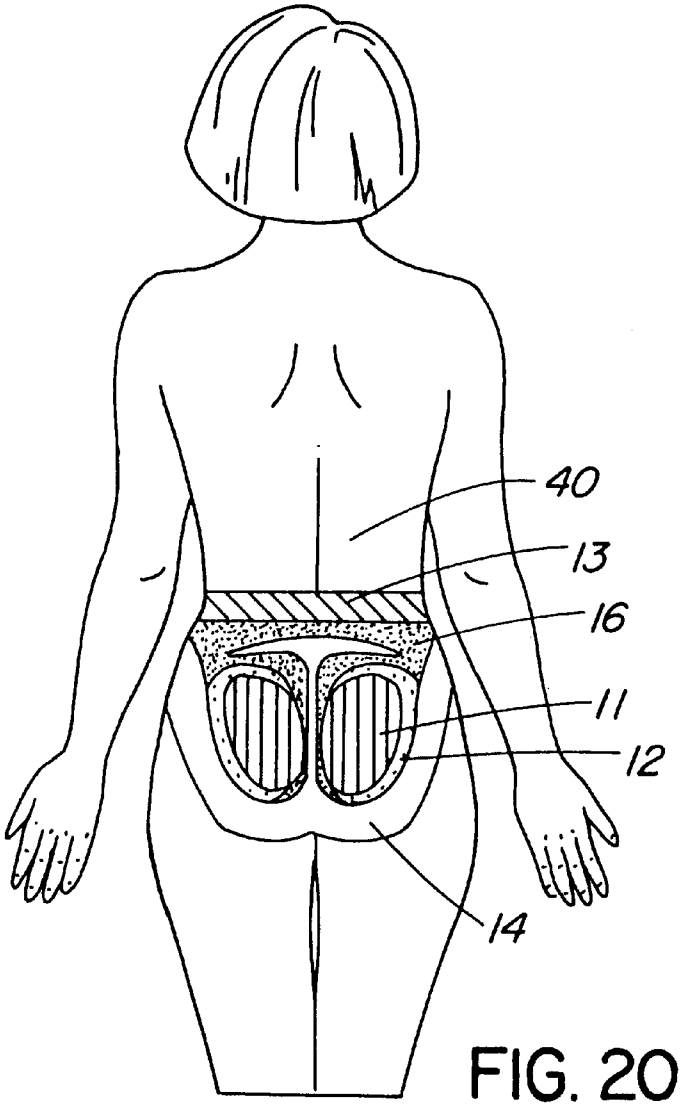
FIG. 20 is a back view of FIG. 19.
Figure 19:
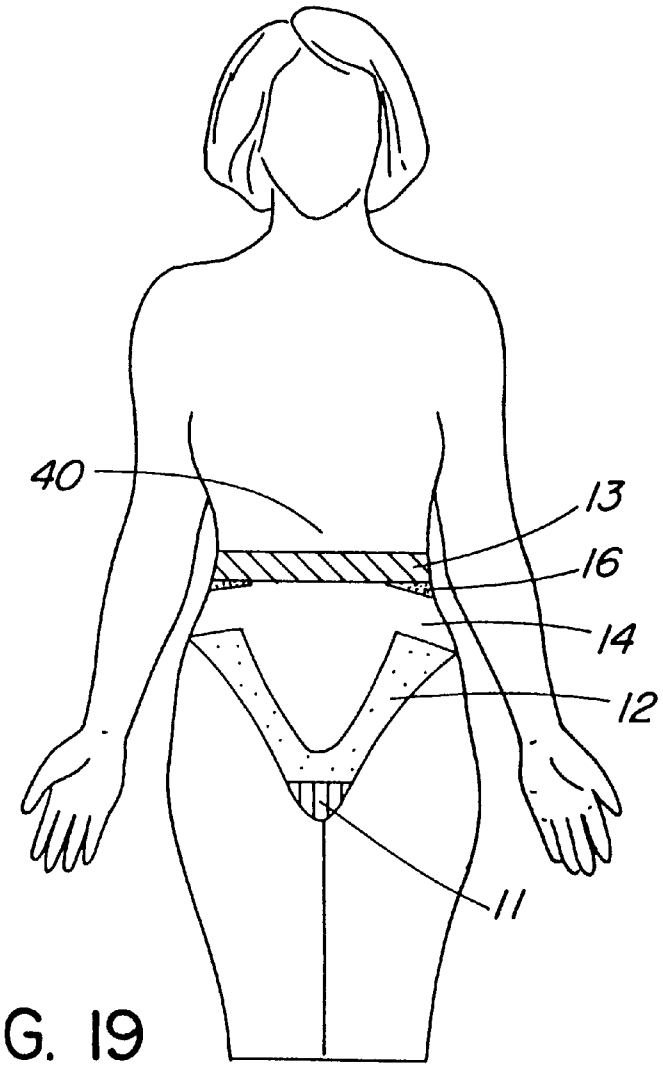
FIG. 19 is a front view of a second modification of the panty-buttock liner of FIG. 17.

Band areas (indicated as 13 in the Figures) include the following: waistband (FIGS. 1–20) or braband FIGS. 5, 7 and 11:

Suggested type of stitch: E12×2a (see FIG. 23(*f*));

Type of yarns:

4×40 spandex+20 nylon (4 feed)

4×100 nylon (4 feed)

2×bare spandex 100 (4 feed)

100 nylon flat shiny (4 feed)

However, it is to be understood that the present invention is not restricted to a selected types of stitches mentioned above, since it is contemplated that other equivalent modifications can be used to obtain similar results depending upon the requirements of use and the degree of control of support and sculpturing desired.

Proper selection of stitches according to the present invention provides for the following results: light stitching in soft selection areas (11) such as the breasts, allows the breasts to take their original, natural and not compressed shape; maximum tension stitches in the maximum support areas (14) such as under the bust, efficiently supports the breasts without being uncomfortable to the user. The band areas (13) on the waist and on bras compress those areas to provide additional support of the support structure to keep the complete support structure in place without cutting the figure. Similarly, maximum support stitches (14) within the mid-section, hips and rear portions around legs provide very efficient shaping of those areas in combination with soft areas (11) on buttocks and intermediate support areas (12) around buttocks. This way buttocks are shaped to give them a natural look, and in the same time they are supported around in gradual manner. Anchor portions (maximum support areas 14) of a generally symmetrical T-shape configuration are located in the crack between the cheeks of buttocks (see FIGS. 2, 6, 14, 16 18 and 21) allow to bring up the whole buttock area, yet functions in a discreet manner in that it hides the fact that there is support providing the desired figure. The symmetrical T-shaped anchor portions have a tendency to be pulled to each other, thus facilitating the lifting and shaping of buttock areas into a naturally looking forms. This pulling action, that lifts and shapes the buttock area is a one of the advantageous features of the present invention.

The present invention has been described with regard to preferred embodiments. However, it will be obvious to persons skilled in the art that a number of variations and modifications can be made without departing from the scope of the invention as described herein.

The embodiments of the invention in which an exclusive property of privilege is claimed are defined as follows:

1. A swim suit comprising an outer garment and an inner liner, wherein said inner liner is joined along at least a portion of its perimeter to said outer garment, said entire inner liner being a seamless support structure and comprising a maximum support stitch, a medium support stitch, and a soft selection area stitch.

2. The swim suit of claim 1 wherein i) said maximum support stitch is used under the bust, mid-section, anchor portions around buttocks, rear portions around legs, or hip portions, or a combination thereof;

ii) said medium support stitch is used in the waist and rear portions, or around legs, or a combination thereof;

iii) said soft selection area stitch is used in the bust, buttock, or crotch areas or a combination thereof.

3. A seamless swim suit comprising:

i) a maximum support stitch, under the bust, mid-section, anchor portions around buttocks, rear portions around legs, or hip portions, or a combination thereof;

ii) a medium support stitch, in the waist and rear portions, or around legs, or a combination thereof;

iii) a soft selection area stitch, in the bust, buttock or crotch areas or combination thereof.

4. A seamless support structure characterized in comprising at least two different yarns, or a combination thereof, that impart a support and control function to said seamless support structure, and further comprising a maximum support stitch, a medium support stitch, a soft selection area stitch, or a combination thereof, wherein said, maximum support stitch, is used under the bust, mid-section, anchor portions around buttocks, rear, portions around legs, or hip portions, or a combination thereof, said medium support stitch, is used in the waist and rear portions, or around legs, or a combination thereof, and said soft selection area stitch, is used in the bust, buttock, or crotch areas or a combination thereof.

5. The seamless support structure of claim 4, wherein said seamless support structure is a liner for a swim suit, and is attached along at least a portion of its perimeter to said swim suit.

6. The seamless support structure of claim 5, wherein said seamless support structure is a bra liner comprising a maximum support stitch under the bust, and a soft selection area stitch, in the bust.

7. The seamless support structure of claim 5, wherein said seamless support structure is a mid-section liner comprising a maximum support stitch, in the mid-section, anchor portions around buttocks, rear, portions around legs, or hip portions, or a combination thereof, a medium support stitch, in the waist and rear portions, or around legs, or a combination thereof, and a soft selection area stitch, in the buttock, or crotch areas or a combination thereof.

8. The seamless support structure of claim 5, wherein said support structure is a panty liner comprising a maximum support stitch, in anchor portions around buttocks, rear, portions around legs, or hip portions, or a combination thereof, a medium support stitch, is used in the waist and rear portions, or around legs, or a combination thereof, and a soft selection area stitch, is used in the buttock, or crotch areas or a combination thereof.

9. The seamless support structure of claim 4, wherein said support structure is a body suit.

10. The seamless support structure of claim 4, wherein said support structure is a swim suit.

11. The seamless support structure of claim 4, further comprising an intermediate support stitch used between said maximum support stitch and said soft selection area stitch, front areas around legs and around buttocks;

a bra back area stitch used in the bra back area; and a band area stitch used in a waist band and bra band.

12. The seamless support structure of claim 4, wherein the at least two yarns are selected from the group consisting of spandex, bare spandex, nylon, nylon single cover and nylon flat shiny.

13. The swim suit of claim 2 further comprising an intermediate support stitch used between said maximum support stitch and said soft selection area stitch, front areas around legs and around buttocks; a bra back area stitch used in the bra back area; and a band area stitch used in a waist band and bra band.

14. The swim suit of claim 2, wherein said inner liner is attached to the inside of said outer garment.

15. The seamless swim suit of claim 3 further comprising an intermediate support stitch used between said maximum support stitch and said soft selection area stitch, front areas around legs and around buttocks; a bra back area stitch used in the bra back area; and a band area stitch used in a waist band and bra band.

16. The seamless support structure of claim 4 further comprising an intermediate support stitch used between said maximum support stitch and said soft selection area stitch, front areas around legs and around buttocks; a bra back area stitch used in the bra back area; and a band area stitch used in a waist band and bra band.

17. The swim suit of claim 5, wherein said seamless support structure is attached to the inside of said swim suit.

* * * * *